US008678388B2

(12) United States Patent
Nagy

(10) Patent No.: US 8,678,388 B2
(45) Date of Patent: Mar. 25, 2014

(54) GAME ACCESSORY, ESPECIALLY DICE

(75) Inventor: Richárd Nagy, Budapest (HU)

(73) Assignee: Co and Co Communication Reklam es Hirdetesszervezo KFT (HU)

( * ) Notice: Subject to any disclaimer, the term of this patent is extended or adjusted under 35 U.S.C. 154(b) by 0 days.

(21) Appl. No.: 13/393,889

(22) PCT Filed: Sep. 3, 2010

(86) PCT No.: PCT/IB2010/053983

§ 371 (c)(1), (2), (4) Date: Mar. 2, 2012

(87) PCT Pub. No.: WO2011/027327

PCT Pub. Date: Mar. 10, 2011

(65) Prior Publication Data

US 2012/0161392 A1 Jun. 28, 2012

(30) Foreign Application Priority Data

Sep. 3, 2009 (HU) ..... 0900542

(51) Int. Cl.
*A63F 9/04* (2006.01)

(52) U.S. Cl.
USPC ..... 273/146

(58) Field of Classification Search
None
See application file for complete search history.

(56) References Cited

U.S. PATENT DOCUMENTS 2,090,837 A * 8/1937 Gould ..... 273/146
2,776,521 A * 1/1957 Zimmerman ..... 446/115
3,348,319 A * 10/1967 Harrison ..... 434/219
3,442,044 A * 5/1969 Quercetti ..... 446/124
3,510,134 A * 5/1970 Brooks et al. ..... 273/157 R
3,603,025 A * 9/1971 Heubl ..... 446/94
3,608,906 A * 9/1971 Odier ..... 273/157 R
3,799,554 A * 3/1974 Simons ..... 273/146
3,904,208 A * 9/1975 Grossman ..... 273/146
3,940,142 A * 2/1976 Hinz et al. ..... 273/146
4,183,167 A * 1/1980 Jatich ..... 446/118
4,452,588 A * 6/1984 Smith ..... 434/207
4,731,041 A * 3/1988 Ziegler ..... 446/115
4,886,477 A * 12/1989 Ziegler ..... 446/104
4,902,259 A * 2/1990 Ziegler ..... 446/117
5,098,328 A * 3/1992 Beerens ..... 446/128
5,150,900 A * 9/1992 Onzo ..... 273/146
5,261,666 A * 11/1993 Chen et al. ..... 273/146
5,344,145 A * 9/1994 Chadwick et al. ..... 463/31
5,348,300 A * 9/1994 Jennings ..... 273/146
5,427,375 A * 6/1995 Breckwoldt ..... 273/153 S
5,556,096 A * 9/1996 Eardley et al. ..... 273/146
5,853,314 A * 12/1998 Bora ..... 446/120
5,890,716 A * 4/1999 Bofinger et al. ..... 273/146
6,116,980 A * 9/2000 Bauer et al. ..... 446/104
6,186,855 B1 * 2/2001 Bauer et al. ..... 446/104
6,381,006 B1 * 4/2002 Ramstrom ..... 356/4.01
6,592,421 B1 * 7/2003 Clever ..... 446/108
6,786,485 B2 * 9/2004 Frieman ..... 273/146
6,902,277 B1 * 6/2005 Ehrne ..... 353/119
6,952,499 B1 * 10/2005 Vititoe ..... 382/224

(Continued)

*Primary Examiner* — Kurt Fernstrom
*Assistant Examiner* — Dolores Collins

(57) ABSTRACT

The invention relates to a game accessory, especially dice, comprising a polygonal body (1) delimited by side surfaces (2) and markings (5) carrying different meanings arranged on the body (1) according to a predetermined rule or in a definite manner, wherein the markings (5) are created as spatial—3D—local mechanical shape alterations along the joining edges (3) of the side surfaces (2) delimiting said body (1).

11 Claims, 4 Drawing Sheets

(56) References Cited

U.S. PATENT DOCUMENTS 7,000,918 B1 * 2/2006 Tan ..... 273/146
7,079,234 B2 * 7/2006 Vogel ..... 356/141.1
8,033,547 B1 * 10/2011 Bryce ..... 273/146
8,152,797 B2 * 4/2012 Boutoussov et al. ..... 606/13
8,398,081 B1 * 3/2013 Girolmo et al. ..... 273/268

* cited by examiner

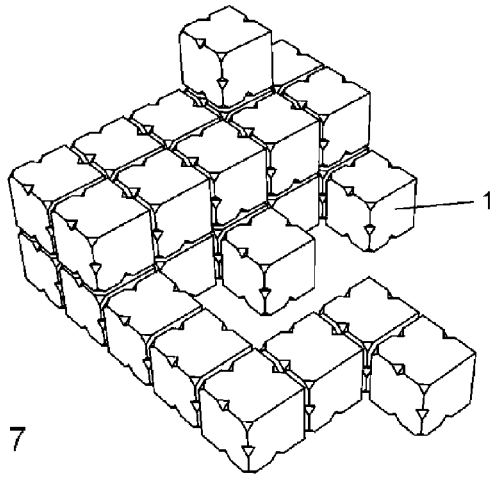
Fig. 7
Fig. 8
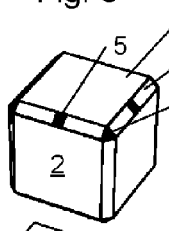
Fig. 9
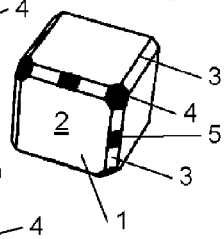
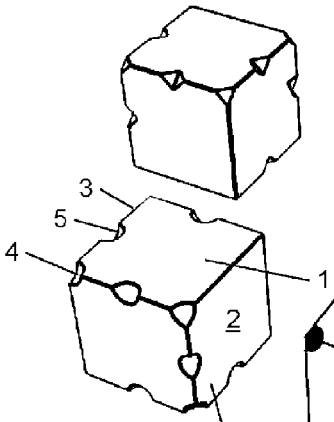
Fig. 10
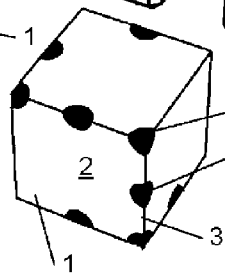
Fig. 11

GAME ACCESSORY, ESPECIALLY DICE

TECHNICAL FIELD

The invention relates to a game accessory, especially dice, comprising a polygonal body delimited by side surfaces and markings carrying different meanings arranged on the body according to a predetermined rule or in a definite manner, as defined in the preamble of Claim 1.

BACKGROUND ART

From ancient times and especially for games men have used game accessories to generate random values, most numbers or outcomes during the game; the accessory concerned is the rolled dice, also called gaming dice or simply dice or die. It should be noted that present description will use the term "dice" as it is used in common speech, but the component it refers to is by no way limited to a cube in the geometrical sense, most used as a dice, i.e. the hexahedron, but as will be shown in the description below, it may take various forms.

The dice which, after being rolled on a horizontal, mostly plane, surface, lands in one of its several home positions and which is used as a random number generator in several games is commonly known. For this purpose, dice usually bear groups of markings of which one only is visible and regarded as valid once the rolled dice regains a home position. This marking, most often a number, is what indicates and provides the value of the roll or identifies the action to be taken based on the roll.

The side surfaces of the dice which corresponds to the most common interpretation of the term show values indicated most frequently by spots or pips, namely 1 to 6 spots, applied, imprinted, painted etc. on the faces of the dice, preferably symmetrically to its centre. As is well-known, the numbers on each side surface, that is, the spots, are arranged so as to combine pairs of numbers that total 7 on diametrically opposed point side surfaces. That is, the markings of 1 and 6, 2 and 5, 3 and 4, respectively, are located on diametrically opposed faces. Although for most people the dice is equivalent to said cube outlined above, in fact, similar game accessories, but not of the most widespread hexahedral type, but maybe of the form of a simple or double pyramid (octahedral) or some other body with more faces or faces of different sizes or, as the case may be, even asymmetrical or randomly shaped bodies are used for similar purposes in many games the world over. The common characteristic of these bodies is that their design allows them to take up a specific home position during the game, i.e. their use, after being rolled, so that the number or value shown on the rolled dice should be clear and unambiguous. Dice of ten and even 30 sides are also known, with the spots being replaced—the higher the scores/values concerned, the more often—by other symbols, mostly numbers for, with a 30-sided dice, for example, it would be difficult to arrange 30 spots and practically impossible to read the number correctly if such a quantity of spots were to be counted after each roll.

The material and design of the dice may vary: the most common dice are made of bone, stone, plastic or wood; their colour depends fully on the intention of the manufacturer, the same as the colouring/size of the spots; no specification or standards exist. To facilitate their use, the vertex as well as edges of most dice are more or less rounded, which makes it more pleasant to handle them, and also easier and simpler for the rolled dice to turn over to another face, whether across an edge or a vertex.

Neither is the size of the dice defined or restricted; it ranges from miniature cubes with an edge length of 3-4 mm for travel games to as big as man-sized cubes, often made of extruded or expanded polystyrene foam, used mostly for community games or media events.

Another most essential feature of the dice, a requirement imposed by the game, is that its shape, size, weight should be such as to be indifferent as far as the outcome of the roll is concerned. Therefore, the material of the dice is chosen so as to have the most even weight distribution possible inside the dice. There is a long history of efforts to bias dice rolls by putting a small weight made of a heavier metal such as lead into the material of the cube to guarantee a statistically uneven outcome, i.e. the more frequent occurrence of the bottom position of the heavier side, with the number or value on the opposite side being shown as the winner one.

In some types of usage, in casinos in the first place, every parameter of the dice is specified most precisely; a dice can only be used for a few hours and, for example, roundings as indicated above are forbidden, because their size and shape cannot be checked by the naked eye, and occasional dissimilarities due mainly to manufacturing errors, i.e. not intentional ones, could influence the outcome and are therefore not permitted in such areas.

To prevent fraud, dice are often made of transparent or semi-transparent materials, which makes it more difficult to read the number or spots displayed on the rolled dice, but ensures easy identification of the above-mentioned manipulation or cheating. This solution, however, does not ensure prompt recognition by the naked eye of unequal edge lengths—which may also influence the outcome of the roll—, especially not if a single dice is used in the game, and hence different or unusual dice dimensions cannot be revealed by the simultaneous observation of the other dice or other dice.

Another feature of the traditional dice, taken into account less frequently, is that the hexahedral shape makes the dice highly suitable for building various configurations out of them. On traditional dice, however, the spots on dice placed side by side or on top of/under each other are always read separately, that is, the total of the spots of two juxtaposed dice will be a minimum of 2 and a maximum of 12, and any deviation from that rule would require the specification and observation of a complex set of new rules, difficult to apply in practice.

DE 19649297 C1 describes a game accessory similar to a dice, which comprises a polyhedral body the main surfaces of which lie opposite one another in pairs and function as support surface or display surface. According to that solution, the main surfaces are designed on the body so that the symmetry axes of the support and display surfaces opposite one another be inclined relative to one another. Consequently, the shape of this gaming device will be such that, as opposed to the traditional dice, instead of moving along a generally straight line when being rolled, it can change direction more directly and swiftly. This solution highlights the use of elliptical main surfaces, where the main axes of the main surfaces opposite one another are perpendicular to one another. At the end of a certain motion flow, this gaming device occupies (and remains in) a position in which its generally upward-looking main surface displays a certain outcome or symbol, which/the value of which tells the next step in a game or gaming device played with a dice. Such gaming devices similar to the dice can be used and are used also alone, that is, without other accessories or props, for the purposes of games or entertainment.

The shape of the gaming device described above is such that so-called secondary surfaces are also formed in addition to the already mentioned main surfaces, and due to the decisively elliptical shapes, one cannot speak of traditional edges and vertices either. Therefore, the roll values/results are indicated for the users of the dice by the different colours of its main surfaces or by indicia on its main surfaces. Of course, in addition to the main surfaces, the secondary ones can also be coloured or marked, which raises the number of numbers/symbols that the dice can display.

Although this known dice mentioned above can produce more unexpected results due to its shape (than a traditional one), given its design, it can only be used alone or multiplicated; however, since in the latter case there is again no connection or co-operation between the numbers/symbols visible on the individual gaming devices, although the proposed gaming device makes the game more varied, the number of events which depend on the dice roll undergoes no increase of merit.

DE 102005023746 A1 proposes a dice arrangement whereas the hexahedral shape of the traditional dice is retained, but three dice are used simultaneously instead of one, with numbers in the range of 1 to 9 indicated on the faces of each dice, and the resulting numbers are meant to provide for a higher number of variations in terms of the roll total attainable by the dice when three dice are used simultaneously. This solution also adheres to the design of the traditional dice and the customary spots used there, and the number of markings/spots on each face can be selected essentially at one's discretion, but since a single dice obviously cannot show nine different indicia schemes, the even distribution of the latter on the faces of the individual dice can/must be ensured by statistically supported calculations.

DE 19831711 C2 describes a gaming dice of the traditional hexahedral shape, that is, with six edges and eight vertices, but with cubical or spherical or cylindrical bodies realised on the vertices of the cube to trigger preferred or selected positions, said bodies strongly protruding from the plane of the dice, and provided with at least one support surface. The purpose of this known solution is to limit the roll distance and prevent lest the dice should roll off the surface, e.g. tabletop, upon which it is rolled, to make the game clearer and faster. The roll value is again indicated on the faces of the dice, in the form of spots, for example, so the course of the game is not affected by the dice or the indicia.

DE 200102924 U1 describes a dice of a hexahedral shape, with identical markings on every two opposite faces, which are definitely not numbers or spots, but simple figures clearly recognizable to the naked exe. This gaming dice was meant to be part of an unknown game developed by its inventor, but the reason for the reduced number of markings is unknown.

DE 29606681 U1 proposes a dice which comprises a relatively large, transparent, hollow hexahedral closed body, with several smaller traditional dice placed therein. The purpose of this dice is again that it should travel but a little, along a short distance, when being rolled on the tabletop or some other surface, lest it should fall down, while at the same time the roll total indicated by the freely moving dice located in it can be read by the unaided eye, which accelerates the game. Apart from this special design, the dice themselves possess no new feature and do not affect the process of the game.

DE 3621744 describes a dice game which comprises several essentially traditional dice, flexibly linked to one another at one vertex of each, so that several, according to the example three, dice can be rolled by one roll, their flexible connection hindering in no way that each cube should come to a home position independent of one another and display a roll value that is probably to be totalled during the game. This circumstance notwithstanding, this solution proposes no novelty as far as the game is concerned, and the interlinked cubes are also of the traditional hexahedral kind.

GB 1187095 describes a dice essentially of the traditional hexahedral shape, but with markings which, instead of showing numbers, indicate directions in which the players must move their game components during the game. In this solution, the markings almost protrude from the plane of the faces of the cube, and are not suitable to carry a different meanings if several dice are used in combination than e.g. two dice used independently.

US 2003/0218299 A1 describes a method for manufacturing a dice and the resulting dice. The solution focuses primarily on professional dice user areas such as casinos or dice houses etc., and defines in detail how to make the individual spots of a traditional hexahedral dice and how to apply the paint to realise the indicia. This solution does not mention any other features or novel uses of the dice.

US 2002/0024176A1 describes a gaming device made of two united dice or, if you please, 3D dominoes. One game component bears such markings as if two dice were actually juxtaposed, with the difference that it has empty faces as well like a domino, and the way the game is played is also more akin to the well-known domino game than to the more widespread dice games.

WO 2007/107011 A1 describes a 3D game and method, in which such a hexahedral dice is used as in the old games, but the faces of the dice are marked by increasing numbers, and the actual meaning of each face is to be calculated according to the rules of an interactive computer game.

WO 2006/052350 A1 describes a dice which is substantially hexahedral in shape, with numbers realised on its side surfaces, but the edges and vertices of the dice also play a role in the determination of the attained roll total, according to the rules of a game which is mostly played in casinos.

DISCLOSURE OF INVENTION

Technical Problem

The object of the present invention is to increase the variation options of the numbers which can be arrived at by using the traditional dice while retaining the hexahedral shape of the latter.

Its object, moreover, is to realise the markings so as to provide for further value variations to be evaluated according to freely definable game rules if several dice are fitted together.

Another object of the invention is to design the markings so as to provide persons with sight impairment an opportunity to play a game that is simple to follow and to use.

Yet another object of the invention is to provide with the help of the markings and the combination of the dice at one's discretion an aesthetically appreciable game or one that is of a different nature than the usual ones.

It is our intention to realise the above objects with the help of dice that are simple, easy and cheap to manufacture.

Technical Solution

The invention is based on the recognition that if, instead of being placed/applied on the side surfaces in the traditional way, the markings are realised expressly along the edges which join the side surfaces or at the vertices of the dice-type game component and, moreover, if the markings are realised as shapes which can be read not only alone but also in combination with one or several others, then it is possible to provide for a higher number of variations during the game than before, which will boost the possible variations of playing the games and will allow to develop new games.

Said task has been solved by a dice-type game accessory as described in Claim 1.

Preferred embodiments of the invention are described in the dependent claims.

DESCRIPTION OF DRAWINGS

The invention will be described in more detail with reference to the attached drawings showing some embodiments of the proposed game accessory. In the drawings.

FIG. 7 is a view of an exemplary domino-like composition made up of game accessories according to FIG. 1; and FIGS. 8-11 show further possible embodiments of the dice-type game accessory according to the invention.

BEST MODE

Figure 1:
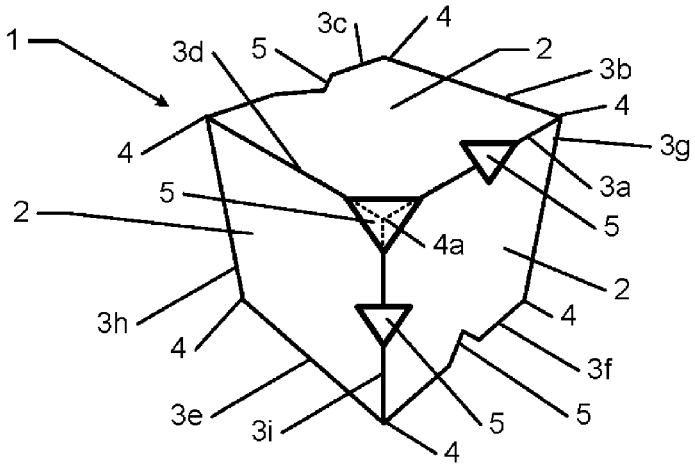
FIG. 1 is a perspective view of a possible embodiment of the dice-type game accessory according to the invention.

Let us proceed now to the detailed description of the invention: FIG. 1 shows an exemplary embodiment of the dice-type game accessory according to the invention, which limits in no way the possible design variations of the game accessory according to the invention. Body 1 of the game accessory is delimited by the usual hexahedral side surfaces 2 which meet at edges 3, and every three side surface 2 intersect in one vertex 4 each. Side surfaces 2 of body 1 do not display the customary point-like markings or figures; instead, markings 5 are designed/realised in a novel way on edges 3 and/or vertices 4, depending on the number of markings to be realised and/or displayed. In the case shown in FIG. 1, markings 5 are realised as V-shaped notches of e.g. 45° perpendicular to edge 3 of body 1 and pointing in the direction of the centre of body 1, that is, each marking 5 is essentially composed of two plane triangles, the area of which depends on the depth of the notch, that is, the size of marking 5. In the case under study, marking 5 may be given a different colour than side surface 2 of body 1 by painting or in some other known manner, but the same effect can also be realised by making marking 5 actually of the same colour as the material of body 1, and applying a different colour on side surfaces 2 of body 1 by some known subsequent operation. Coating may be combined with covering side surfaces 2 by some material which is different from the material of body 1 to provide the game accessory, in addition to the colouring, a different, e.g. more pleasant, appearance or feel, as the case may be. In the exemplary case, a single marking 5 is made along edge 3*a* of body 1, at its middle, and, similarly, one marking is to be found at the middle of edges 3*c* and 3*f*, 3*i*, respectively, but there is no marking 5 along edges 3*b*, 3*e*, 3*g* or 3*h*. Body 1 furthermore contains a marking 5 also at its vertex 4*a* (represented by dotted lines), which is a notch formed in the same direction as the other markings 5, so that vertex 4*a* of body 1 is visibly chopped. Of course, it is possible to realise more than one marking 5 along a single edge 3, although this has not been represented in the Figures.

Edges 3 interconnecting side surfaces 2 are preferably, albeit not necessarily, somewhat rounded, that is, edges 3 and vertices 4 of body 1 are not sharp and do not prick.

Figure 2:
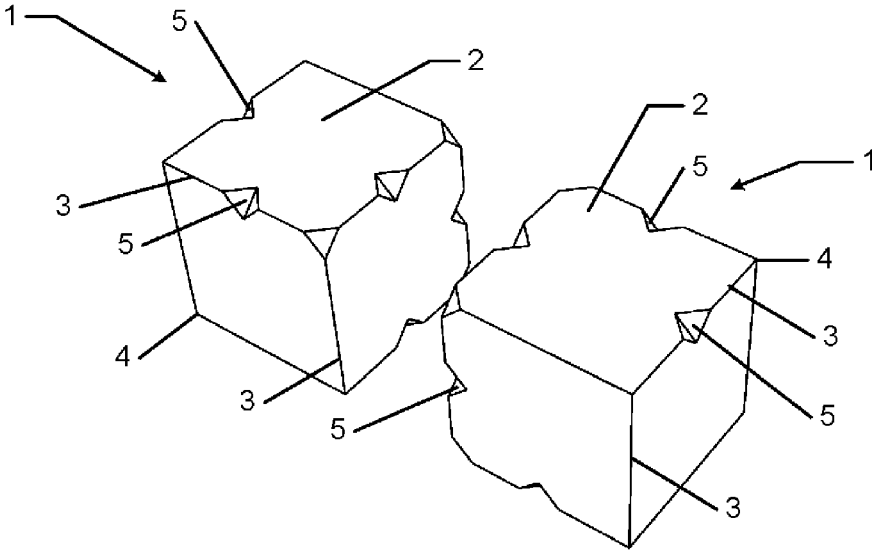
FIG. 2 shows two pieces of the game accessory according to FIG. 1 in different positions.

FIG. 2 actually shows the body 1 according to FIG. 1 doubled and rotated, to make it easier to understand how markings 5 are realised along edges 3 and vertices 5 of body 1.

Figure 3:
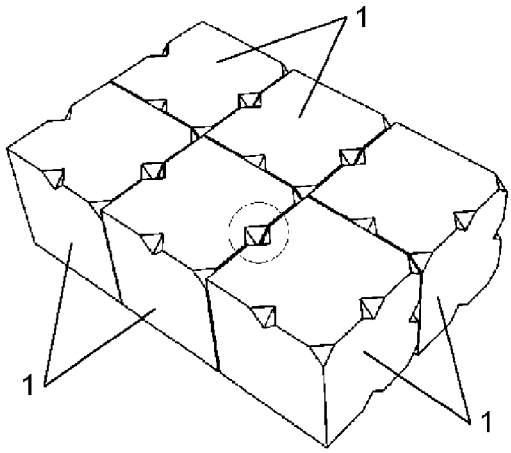
FIG. 3 is a perspective view of six pieces of the game accessory according to FIG. 1, in two rows of 3 pieces each.
Figure 4:
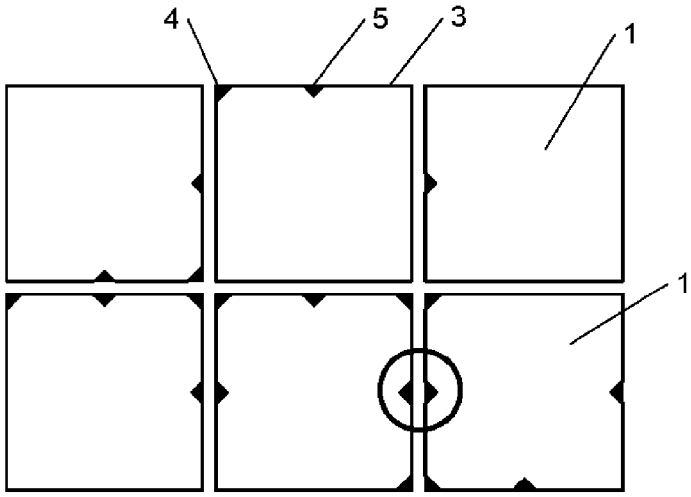
FIG. 4 is the top view of the arrangement according to FIG. 3.

FIG. 3 provides a perspective view and FIG. 4 a top view of two juxtaposed rows of three bodies 1 each, placed side by side. In the figures, the parts highlighted by rings clearly show that the adjoining bodies 1 fitted together at markings 5 formed at identical positions of body 1, opposite one another, may be read either as two markings or as a single one, and that can make a given game rather varied provided that the relevant rules are specified appropriately. If four bodies 1 are fitted together—in two dimensions—, so as to provide a single square, with markings 5 at adjoining vertices 4, then markings 5 of the assembled bodies 1 appear as a single pyramid-shaped cavity rotated by 90°, which can again also be read as a single marking if the rules applicable to the game played with bodies 1 are such. Note that the hiatuses between bodies 1 in FIG. 4 are meant exclusively to facilitate understanding; in practice, no such hiatus is necessary.

Figure 5:
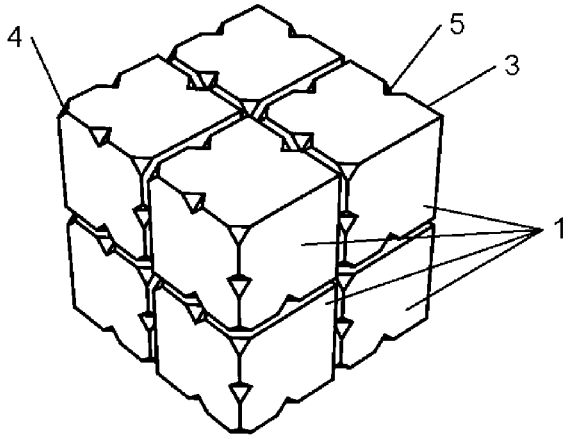
FIG. 5 shows a cube form composed of eight pieces of the game accessory according to FIG. 1.
Figure 6:
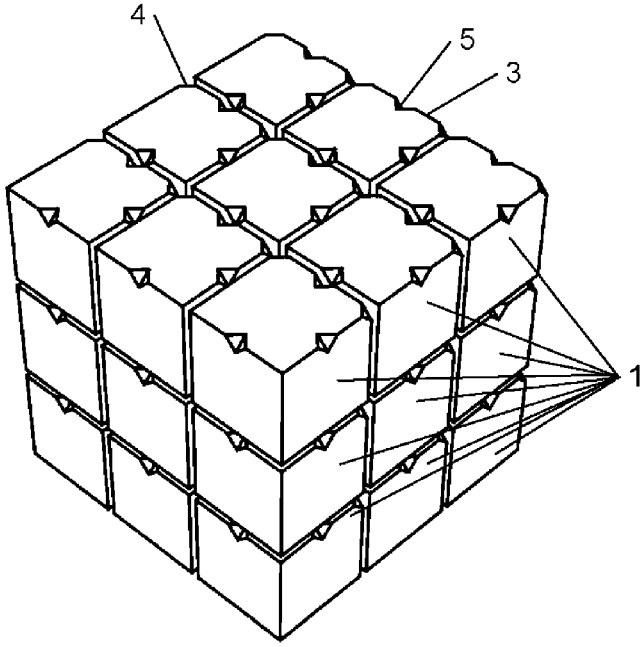
FIG. 6 is the perspective view of a cubic form composed of three times three game accessories.

FIGS. 5 and 6 show a perspective view of cubes made of 8 and 27 bodies 1, respectively, which clearly demonstrate the versatility of body 1 according to the invention, and the possibility to read the markings either independently or in combination.

FIG. 7, on the other hand, represents a possible version or more precisely arrangement where bodies 1 according to the invention are fitted together like dominoes, either according to the rules of the domino game, or according to rules which take into account the possible ways in which markings 5 are realised.

Over and beyond the realisation of the game accessory according to the invention described in detail in connection with FIG. 1 (indicated again for the sake of comparison on the left-hand side), FIGS. 8-11 shows some other possible embodiments, by way of example. In the embodiment shown in FIG. 8, edges 3 of body 1 are not slightly rounded, as in the one shown in FIG. 1, but are more definitely bevelled, and hence markings 5 realised along the bevelled 3 edges and 4 vertices appear differently for the viewer or the user than the notch-like markings 5 used for the bodies 1 represented in FIGS. 1-7.

If not only edges 3 delimiting the bottom and top surfaces 2 of body 1, but also the vertical edges 3 of body 1 are bevelled, then markings 5 created on edges 3 have the shape of a rectangle in landscape position, and markings 5 realised at vertices 4 will be hexagonal, as opposed to the design shown in FIG. 8, where markings 5 created on edges 3 have the shape of a rectangle in portrait position, and markings 5 at vertices 4 of a triangle.

Markings 5 contained in body 1 shown in FIG. 10 differ from the ones delimited by straight lines shown insofar as that they are arched depressions with the corresponding projections.

In the embodiment shown in FIG. 11, the arched outline of markings 5 is different in size from markings 5 shown in FIG. 10, and whereas in the latter markings 5 are realised as depressions and are perceived as such, in the case shown in FIG. 11, the depressions of markings 5 are filled in with a material of a different colour and hence there is no break in body 1. Of course, beside the application of a different colour, markings 5 can be differentiated from the material of body 1 by other known methods as well; as will be obvious to those skilled in the art, materials of a different appearance/feel are suitable for this purpose.

It is a common feature of the possible embodiments described above that, looking at a single side surface 2, one will see a maximum of four markings 5 created on edges 3 and a maximum of four markings 5 created at vertices 4 simultaneously, that is, one face 2 can display no more than 8 number values. The number of markings 5 realised on a body 1 can be chosen freely in function of the use ever, so it is possible to imagine a case when body 1 has a side surface 2 where no marking 5 is seen on any of the delimiting 3 edges or 4 vertices. That is, we can declare that the minimum number of 5 markings is zero and the maximum number in the simple case presented above is eight, and the latter will only increase if more than one marking 5 is realised along one edge 3 between two vertices 4.

Apart from its primary role as a gaming dice, the proposed game accessory can also be used as a dice tower or an aesthetic puzzle, provided that markings 5 are of appropriate shape and size.

The invention claimed is:

1. A game accessory, especially dice comprising:

a polygonal body (1) delimited by planar side surfaces (2), markings (5), arranged on the body (1) according to a predetermined rule such that one or more markings combine to provide different overall appearances along joining edges (3) of the side surfaces (2) to impart information to a user, characterised in that said markings (5) are created as spatial three-dimensional local mechanical depressions along the joining edges (3) of the side surfaces (2) delimiting said body (1), such that a position and appearance of markings (5) on the body (1) impart information to a user, either alone, or in combination with markings (5) on an adjacent game accessory.

2. Game accessory according to claim 1, characterised in that the depressions are realised as notches.

3. Game accessory according to claim 1, characterised in that the colour of markings (5) differs from that of the side surfaces (2).

4. Game accessory according to claim 1, characterised in that markings (5) are of different colours.

5. Game accessory according to claim 1, characterised in that further markings (5) are realised at the meeting spots of edges (3), that is, at vertices (4).

6. Game accessory according to claim 1, characterised in that markings (5) are realised exclusively along at least one edge (3) section of side surfaces (2).

7. Game accessory according to claim 1, characterised in that further markings (5) are realised exclusively at at least one meeting point of the edges, i.e. one vertex (4).

8. Game accessory according to claim 1, characterised in that markings (5) are realised both along edges (5) and at their meeting spots, i.e. vertices (4).

9. Game accessory according to claim 1, characterised in that it is realised in the form of a symmetric body (1).

10. Game accessory according to claim 9, characterised in that it is realised as a hexahedral body.

11. Game accessory according to claim 1, characterised in that markings (5) are realised so that different numbers of markings are visible in each of the planes of the individual side surfaces (2).

* * * * *